US010930206B2

(12) United States Patent
Zhao

(10) Patent No.: US 10,930,206 B2
(45) Date of Patent: Feb. 23, 2021

(54) ELECTROLUMINESCENT DISPLAY PANEL, DRIVING METHOD THEREOF, DRIVING DEVICE AND DISPLAY DEVICE

(71) Applicant: BOE TECHNOLOGY GROUP CO., LTD., Beijing (CN)

(72) Inventor: Lijun Zhao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 98 days.

(21) Appl. No.: 16/301,832

(22) PCT Filed: Apr. 18, 2018

(86) PCT No.: PCT/CN2018/083470
§ 371 (c)(1),
(2) Date: Nov. 15, 2018

(87) PCT Pub. No.: WO2018/192510
PCT Pub. Date: Oct. 25, 2018

(65) Prior Publication Data

US 2019/0164475 A1 May 30, 2019

(30) Foreign Application Priority Data

Apr. 21, 2017 (CN) ..... 201710265215.X

(51) Int. Cl.
*G09G 3/36* (2006.01)
*G09G 3/3208* (2016.01)
*G09G 3/00* (2006.01)

(52) U.S. Cl.
CPC ..... *G09G 3/3208* (2013.01); *G09G 3/006* (2013.01); *G09G 3/3688* (2013.01);
(Continued)

(58) Field of Classification Search
CPC .. G09G 3/3696; G09G 3/3233; G09G 3/3208; G09G 3/006; G09G 2320/041;
(Continued)

(56) References Cited

U.S. PATENT DOCUMENTS

2006/0082523 A1* 4/2006 Guo ..... G09G 3/3233 345/76
2007/0176885 A1 8/2007 Jun
(Continued)

FOREIGN PATENT DOCUMENTS

CN 101013229 A 8/2007
CN 101661713 A 3/2010
(Continued)

OTHER PUBLICATIONS

First Office Action for Chinese Patent Application No. 201710265215.X dated Jul. 16, 2018.
(Continued)

*Primary Examiner* — Abdul-Samad A Adediran
(74) *Attorney, Agent, or Firm* — Calfee, Halter & Griswold LLP

(57) ABSTRACT

The embodiments of the present disclosure provide an electroluminescent display panel, a driving method thereof, a driving device and a display device. In response to a detected temperature of the electroluminescent display panel is within an operating temperature range and is higher than a first standard temperature, a driving voltage of the electroluminescent display panel is adjusted to a first driving voltage lower than a standard driving voltage; and in response to the detected temperature of the electroluminescent display panel is within the operating temperature range and is lower than a second standard temperature, the driving voltage of the electroluminescent display panel is adjusted to a second driving voltage higher than the standard driving
(Continued)

voltage. The first standard temperature is higher than or equal to the second standard temperature.

14 Claims, 5 Drawing Sheets

(52) U.S. Cl.
CPC ..... *G09G 3/3696* (2013.01); *G09G 2320/041* (2013.01); *G09G 2320/0626* (2013.01); *G09G 2330/021* (2013.01); *G09G 2330/027* (2013.01); *G09G 2330/04* (2013.01)

(58) Field of Classification Search
CPC ..... G09G 2320/0626; G09G 2330/021; G09G 2330/027; G09G 2330/04
USPC ..... 345/76, 212
See application file for complete search history.

(56) References Cited

U.S. PATENT DOCUMENTS

| | | | |
|---|---|---|---|
| 2007/0182694 | A1 | 8/2007 | Lee et al. |
| 2012/0249516 | A1 | 10/2012 | Wacyk et al. |
| 2014/0312798 | A1 | 10/2014 | Westrick, Jr. et al. |
| 2015/0269901 | A1* | 9/2015 | Kobayashi ..... G09G 3/3696 345/212 |
| 2015/0355488 | A1 | 12/2015 | Wang |
| 2016/0203750 | A1 | 7/2016 | Lebrun et al. |
| 2018/0293937 | A1 | 10/2018 | Tong |

FOREIGN PATENT DOCUMENTS

| | | | |
|---|---|---|---|
| CN | 101840679 | A | 9/2010 |
| CN | 102968961 | A | 3/2013 |
| CN | 102982778 | A | 3/2013 |
| CN | 203456073 | U | 2/2014 |
| CN | 103871385 | A | 6/2014 |
| CN | 104064155 | A | 9/2014 |
| CN | 105493172 | A | 4/2016 |
| CN | 105931596 | A | 9/2016 |
| CN | 106023890 | A | 10/2016 |
| CN | 106356024 | A | 1/2017 |
| CN | 106875889 | A | 6/2017 |

OTHER PUBLICATIONS

Search Report and Written Opinion for International Application No. PCT/CN2018/083470 dated Jun. 27, 2018.

* cited by examiner

ELECTROLUMINESCENT DISPLAY PANEL, DRIVING METHOD THEREOF, DRIVING DEVICE AND DISPLAY DEVICE

RELATED APPLICATIONS

The present application is the U.S. national phase entry of the international application PCT/CN2018/083470, with an international filing date of Apr. 18, 2018, which claims the benefit of Chinese Patent Application No. 201710265215.X, filed on Apr. 21, 2017, the entire disclosures of which are incorporated herein by reference.

TECHNICAL FIELD

The present disclosure relates to an electroluminescent display panel, a driving method thereof, a driving device and a display device.

BACKGROUND

Organic light emitting diode (OLED) displays have been widely used in the field of organic light-emitting technology, and have attracted much attention due to their fast response, wide color gamut, large viewing angle, high brightness, and light weight.

SUMMARY

An exemplary embodiment of the present disclosure provides a driving method of an electroluminescent display panel. The driving method includes: detecting a temperature of the electroluminescent display panel; in response to a detected temperature of the electroluminescent display panel being within an operating temperature range and being higher than a first standard temperature, adjusting a driving voltage of the electroluminescent display panel to a first driving voltage lower than a standard driving voltage; and in response to the detected temperature of the electroluminescent display panel being within the operating temperature range and being lower than a second standard temperature, adjusting the driving voltage of the electroluminescent display panel to a second driving voltage higher than the standard driving voltage; wherein the first standard temperature is higher than or equal to the second standard temperature.

In some exemplary embodiments, adjusting the driving voltage of the electroluminescent display panel to a first driving voltage lower than the standard driving voltage, and adjusting the driving voltage of the electroluminescent display panel to a second driving voltage higher than the standard driving voltage include: determining a temperature range in which the detected temperature of the electroluminescent display panel is located; based on a corresponding relationship between the temperature range and the driving voltage of the electroluminescent display panel, adjusting the driving voltage of the electroluminescent display panel to a driving voltage corresponding to the temperature range in which the detected temperature of the electroluminescent display panel is located.

In some exemplary embodiments, the driving method according to an embodiment of the present disclosure further includes: in response to the detected temperature of the electroluminescent display panel being between the first standard temperature and the second standard temperature, setting the driving voltage of the electroluminescent display panel to the standard driving voltage.

In some exemplary embodiments, the driving method according to an embodiment of the present disclosure further includes: in response to the detected temperature of the electroluminescent display panel not being in the operating temperature range, disconnecting a power supply of the electroluminescent display panel.

In some exemplary embodiments, detecting the temperature of the electroluminescent display panel includes: detecting the temperature of the electroluminescent display panel according to a selected time interval.

An exemplary embodiment of the present disclosure provides a driving device for an electroluminescent display panel. The driving device includes: a temperature sensor, a temperature detecting circuit, a controller, and a driving voltage generator. The temperature sensor is configured to detect a temperature of the electroluminescent display panel. The temperature detecting circuit is configured to determine whether a detected temperature of the electroluminescent display panel is within an operating temperature range, whether the detected temperature of the electroluminescent display panel is higher than a first standard temperature or lower than a second standard temperature; the first standard temperature is higher than or equal to the second standard temperature. The controller is configured to: in response to a detected temperature of the electroluminescent display panel being within the operating temperature range and being higher than the first standard temperature, controlling the driving voltage generator to adjust a driving voltage of the electroluminescent display panel to a first driving voltage lower than a standard driving voltage; and in response to the detected temperature of the electroluminescent display panel being within the operating temperature range and being lower than the second standard temperature, controlling the driving voltage generator to adjust the driving voltage of the electroluminescent display panel to a second driving voltage higher than the standard driving voltage.

In some exemplary embodiments, the temperature detecting circuit is configured to determine a temperature interval in which the detected temperature of the electroluminescent display panel is located. The controller is configured to, based on a corresponding relationship between the temperature interval and the driving voltage of the electroluminescent display panel, adjust the driving voltage of the electroluminescent display panel to a driving voltage corresponding to the temperature range in which the detected temperature of the electroluminescent display panel is located.

In some exemplary embodiments, the number of the temperature sensors is at least two.

In some exemplary embodiments, the driving device further includes a power controller. The power controller is configured to, in response to the detected temperature of the electroluminescent display panel not being within the operating temperature range, disconnect a power supply of the electroluminescent display panel under the control of the controller.

An exemplary embodiment of the present disclosure further provides an electroluminescent display panel including the drive device according to any one of the above mentioned embodiments. In such embodiments, the temperature sensor is located within the electroluminescent display panel.

An exemplary embodiment of the present disclosure further provides a display device including the electroluminescent display panel according to the above-mentioned embodiment.

DETAILED DESCRIPTION OF THE DISCLOSURE

In the following, the technical solutions in exemplary embodiments of the disclosure will be described clearly and completely in connection with the drawings in the exemplary embodiments of the disclosure. Obviously, the described exemplary embodiments are only a portion of the embodiments of the disclosure, and not all of the possible embodiments. Based on the exemplary embodiments of the disclosure, all other embodiments obtained by those of ordinary skills in the art under the premise of not paying out creative work pertain to the protection scope of the disclosure.

The inventors have realized that the luminescent properties of luminescent materials of OLEDs vary with the temperature of the display. When the temperature of the display is lower than a standard temperature, the brightness of the display decreases. Conversely, when the temperature of the display is higher than the standard temperature, the brightness of the display increases. Therefore, when the temperature of the display is different from the standard temperature, the light-emitting state of the OLED display is inconsistent with the light-emitting state at the standard temperature, which affects the appearance of the display.

Figure 1A:
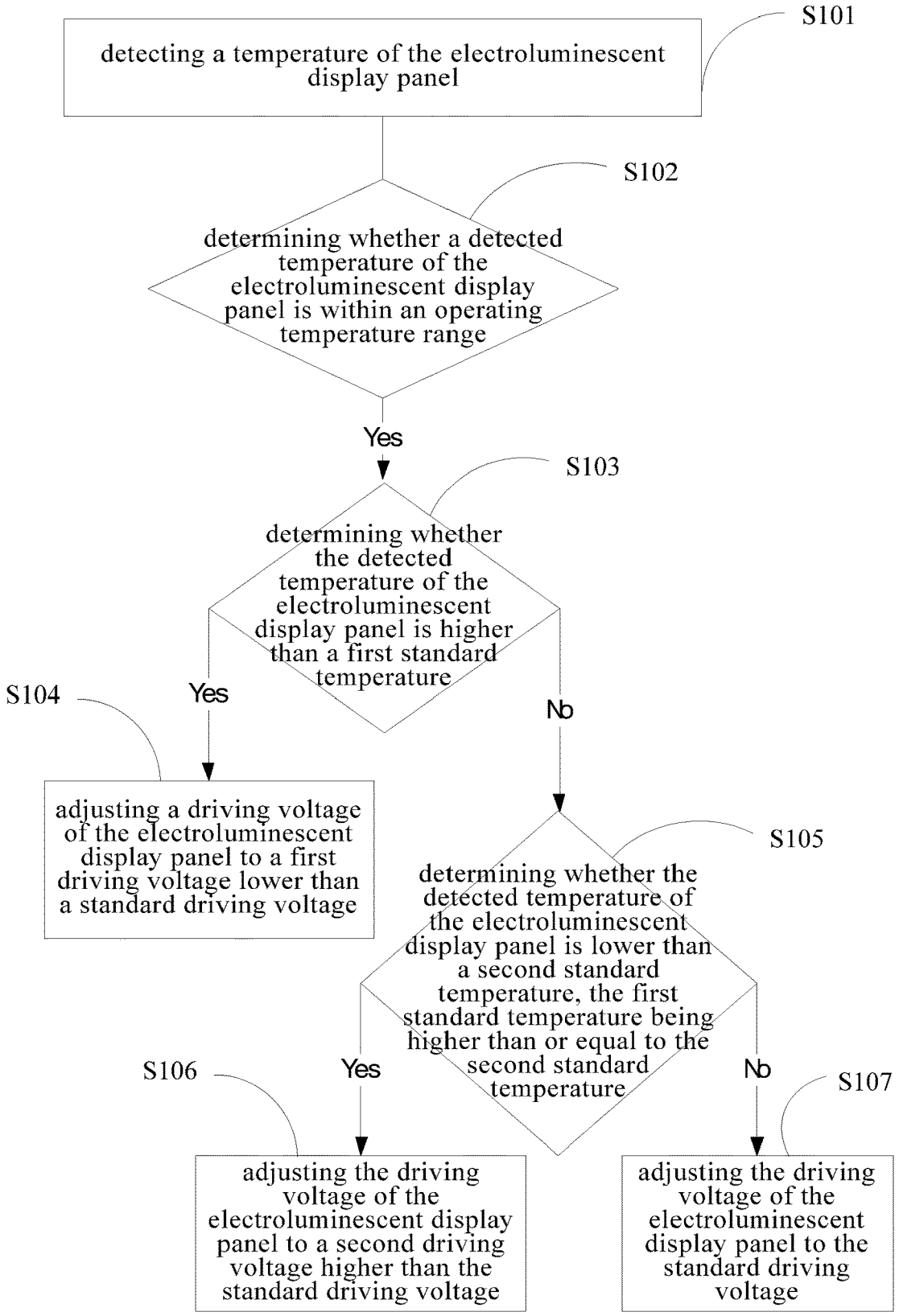
FIG. 1*a* and FIG. 1*b* are flowcharts of a driving method of an electroluminescent display panel according to an exemplary embodiments of the present disclosure.

An exemplary embodiment of the present disclosure provides a driving method of an electroluminescent display panel. As show in FIG. 1*a*, the driving method may include the following steps.

Step S101, detecting a temperature of the electroluminescent display panel.

Step S102, determining whether a detected temperature of the electroluminescent display panel is within an operating temperature range; if yes, executing step S103.

Step S103, determining whether the detected temperature of the electroluminescent display panel is higher than a first standard temperature. If yes, executing step S104; if not, executing step S105.

Step S104, adjusting a driving voltage of the electroluminescent display panel to a first driving voltage lower than a standard driving voltage.

Step S105, determining whether the detected temperature of the electroluminescent display panel is lower than a second standard temperature, the first standard temperature being higher than or equal to the second standard temperature. If yes, executing step S106; if not, executing step S107.

Step S106, adjusting the driving voltage of the electroluminescent display panel to a second driving voltage higher than the standard driving voltage.

Step S107, adjusting the driving voltage of the electroluminescent display panel to the standard driving voltage.

The above driving method provided by the embodiment of the present disclosure is based on the formula $R_t=R_o(1+\alpha T)$, wherein T represents temperature, $\alpha$ represents a temperature coefficient of resistance for a cathode metal conductor of the electroluminescent device, $R_o$ represents the resistance of the cathode metal conductor of the electroluminescent device at 0° C., and $R_t$ represents the resistance of the cathode metal conductor of the electroluminescent device at a temperature of T.

According to the above formula, when the temperature T is increased, the resistance of the cathode metal conductor of the electroluminescent device is increased, so that the cathode voltage of the electroluminescent device is increased, thereby increasing the luminance of the electroluminescent device. When the temperature T is decreased, the cathode voltage of the electroluminescent device is thus decreased, thereby decreasing the luminance of the electroluminescent device.

Therefore, according to the above analysis, when a change in the temperature of the electroluminescent display panel is detected, the cathode voltage of the electroluminescent device is adjusted to change accordingly. By adjusting the driving voltage of the electroluminescent device, the light-emitting state of the electroluminescent display panel is maintained between a light-emitting state corresponding to the first standard temperature and a light-emitting state corresponding to the second standard temperature. Moreover, the driving method does not need to add new manufacturing processes, and does not affect the display quality of the screen. In exemplary embodiments, the driving voltage is adjusted based on the temperature change of the electroluminescent display panel. Normal operation of the electroluminescent display panel is thus ensured, and the reliability and quality assurance of the electroluminescent display panel are improved.

In some exemplary embodiments, the step of detecting the temperature of the electroluminescent display panel includes: detecting the temperature of the electroluminescent display panel based on a preset time interval.

For example, in order to ensure the consistent brightness of the electroluminescent display panel, the temperature of the electroluminescent display panel can be monitored in real time. However, such a detection frequency causes the system to consume high levels of power than are desirable.

In exemplary embodiments, in order to reduce the power consumption of the system, and to ensure that the brightness of the electroluminescent display panel is consistent, the temperature of the electroluminescent display panel can be detected once in a frame display time. A certain time interval can be selected for detection, such as once, without limitation, in 50 ms, once in 100 ms, once in 200 ms, or once in 500 ms.

In some exemplary embodiments, the corresponding relationship between the temperature interval and the driving voltage is set in advance, so as to determine a specific value of the driving voltage according to the detected temperature.

For example, in an exemplary condition in which step S104 of adjusting the driving voltage of the electroluminescent display panel to the first driving voltage lower than the standard driving voltage, and step S106 of adjusting the driving voltage of the electroluminescent display panel to the second driving voltage higher than the standard driving voltage may include: determining a temperature range in which the detected temperature of the electroluminescent display panel is located; based on a corresponding relationship between the temperature interval and the driving voltage of the electroluminescent display panel, adjusting the driving voltage of the electroluminescent display panel to a driving voltage corresponding to the temperature interval in which the detected temperature of the electroluminescent display panel is located.

Figure 5:
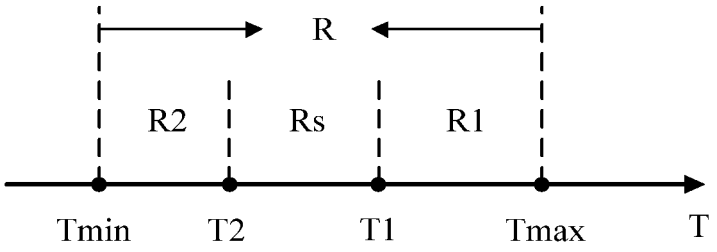
FIG. 5 is a schematic diagram of a temperature interval according to an exemplary embodiment of the present disclosure.

For example, in the corresponding relationship between the temperature interval and the driving voltage, the first standard temperature is higher than the second standard temperature. As shown in FIG. 5, the limit temperature range R can be divided into three temperature ranges by using the minimum limit temperature Tmin, the second standard temperature T2, the first standard temperature T1, and the maximum limit temperature Tmax. Of course, it is not limited to divide the limit temperature range R into three temperature intervals. A temperature range higher than the first standard temperature T1 and lower than or equal to the maximum limit temperature Tmax is taken as the first temperature range R1. A temperature range higher than or equal to the second standard temperature T2 and lower than or equal to the first standard temperature T1 is taken as a standard temperature range Rs. For example, generally the temperature ranges from 25° C. to 30° C. (including 25° C. and 30° C.) is taken as the standard temperature range Rs. A temperature higher than or equal to the minimum limit temperature Tmin and lower than the second standard temperature T2 is taken as the second temperature range R2.

In some exemplary embodiments, the driving voltage corresponding to the first temperature range R1 is the first driving voltage, the driving voltage corresponding to the standard temperature range Rs is the standard driving voltage, and the driving voltage corresponding to the second temperature range R2 is the second driving voltage. Moreover, the first driving voltage is less than the standard driving voltage, which is less than the second driving voltage. Therefore, if it is determined that the detected temperature of the electroluminescent display panel is within the first temperature range, the driving voltage of the electroluminescent display panel is adjusted to the first driving voltage corresponding to the first temperature range.

In some exemplary embodiments, in order to reduce system power consumption, the driving method according to an exemplary embodiment of the present disclosure further includes: in response to the detected temperature of the electroluminescent display panel being between the first standard temperature and the second standard temperature, setting the driving voltage of the electroluminescent display panel to the standard driving voltage.

Figure 1B:
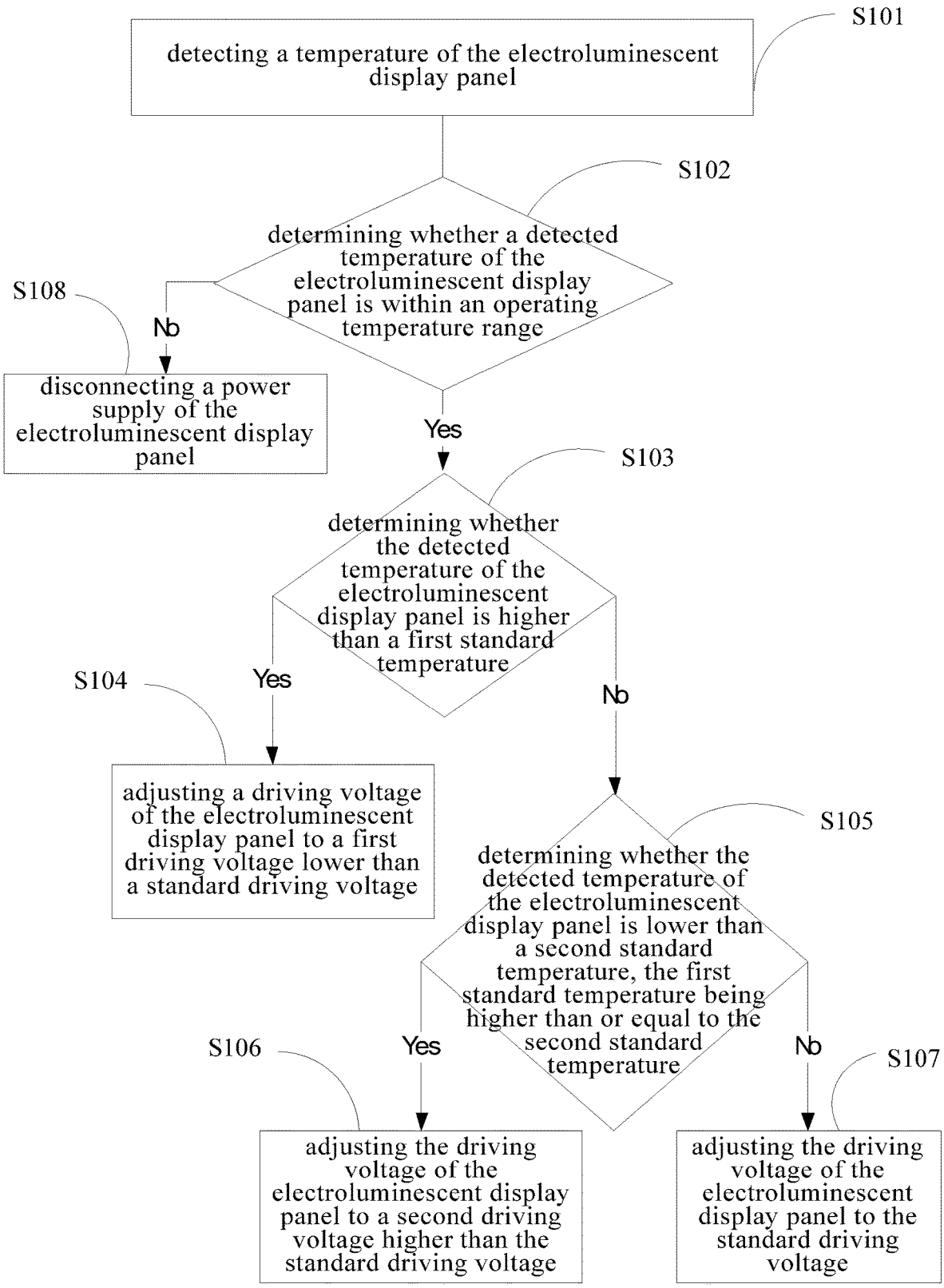

In some embodiments, in order to prevent the electroluminescent display panel from being damaged when the temperature is too high or too low, the driving method according to an exemplary embodiment of the present disclosure further includes: Step S102, which in response to the detected temperature of the electroluminescent display panel not being in the operating temperature range, disconnecting a power supply of the electroluminescent display panel (step S108, as shown in FIG. 1*b*).

An exemplary embodiment of the present disclosure provides a driving device for an electroluminescent display panel. Since the driving device is similar to the foregoing driving method of the electroluminescent display panel, the specific implementation manner of the driving device can be referred to the above driving method. The embodiments are not repeated herein.

Figure 2:
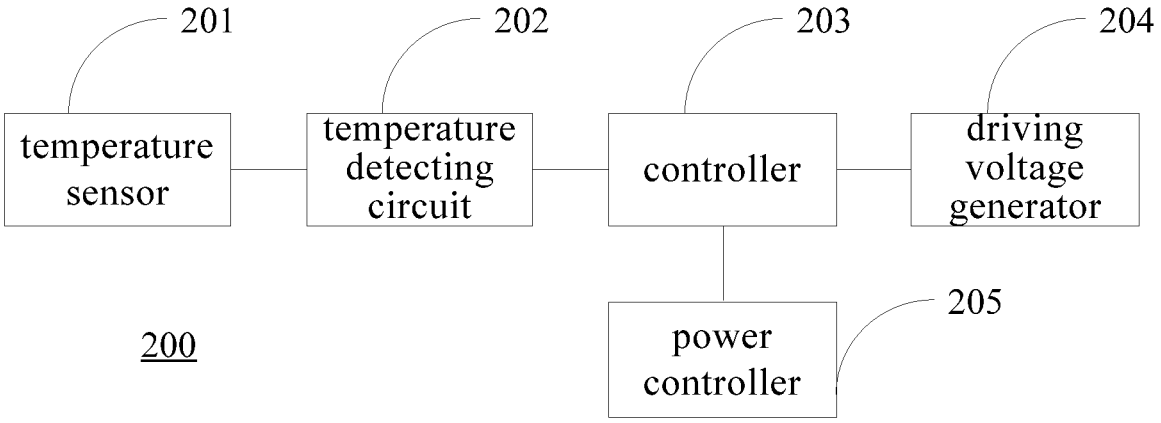
FIG. 2 is a structural schematic diagram of a driving device of an electroluminescent display panel according to an exemplary embodiment of the present disclosure.

Specifically, as shown in FIG. 2, the driving device 200 provided by an exemplary embodiment of the present disclosure may include: a temperature sensor 201, a temperature detecting circuit 202, a controller 203, and a driving voltage generator 204.

The temperature sensor 201 may be configured to detect a temperature of the electroluminescent display panel.

The temperature detecting circuit 202 may be configured to determine whether a detected temperature of the electroluminescent display panel is within an operating temperature range, whether the detected temperature of the electroluminescent display panel is higher than a first standard temperature or lower than a second standard temperature. The first standard temperature is higher than or equal to the second standard temperature.

The controller 203 may be configured to: in response to a detected temperature of the electroluminescent display panel being within the operating temperature range and being higher than the first standard temperature, causing the driving voltage generator 204 to adjust a driving voltage of the electroluminescent display panel to a first driving voltage lower than a standard driving voltage; and in response to the detected temperature of the electroluminescent display panel being within the operating temperature range and being lower than the second standard temperature, causing the driving voltage generator 204 to adjust the driving voltage of the electroluminescent display panel to a second driving voltage higher than the standard driving voltage.

It is easy to understand that the temperature detecting circuit described above is a circuit having a comparator for comparing the temperature detected by the temperature sensor with a preset standard temperature range, so as to determine a detected temperature state of the electroluminescent display panel. Then, the controller 203 generates a corresponding control command based on the temperature state so that the driving voltage generator 204 outputs the required driving voltage. Because modern central processing units (CPUs), microprogrammed control units (MCUs), digital signal processors (DSPs), field programmable gate arrays (FPGAs) and other logic operation processing circuits have built-in functional circuitry or logic circuitry such as controllers and comparators, the temperature detecting circuit 202 and the controller 203 may be combined and implemented in a logic operation processing circuit.

In some exemplary embodiments, the temperature sensor 201 transmits a signal carrying temperature information to the temperature detecting circuit 202 after detecting the temperature of the electroluminescent display panel. The temperature detecting circuit 202 determines whether the detected temperature of the electroluminescent display panel is within the operating temperature range of the electroluminescent display panel. If the detected temperature of the electroluminescent display panel is within the operating temperature range, it is determined whether the detected temperature of the electroluminescent display panel is higher than a first standard temperature or is lower than a second standard temperature, and then the detected temperature information is converted into corresponding voltage information and transmitted to the controller 203. The first standard temperature may be higher than the second standard temperature, or may be equal to the second standard temperature. Then, the controller 203 sends a corresponding control signal to the driving voltage generator 204 based on the detected temperature transmitted by the temperature detecting circuit 202, so as to cause the driving voltage generator 204 to generate a corresponding driving voltage.

Figure 3A:
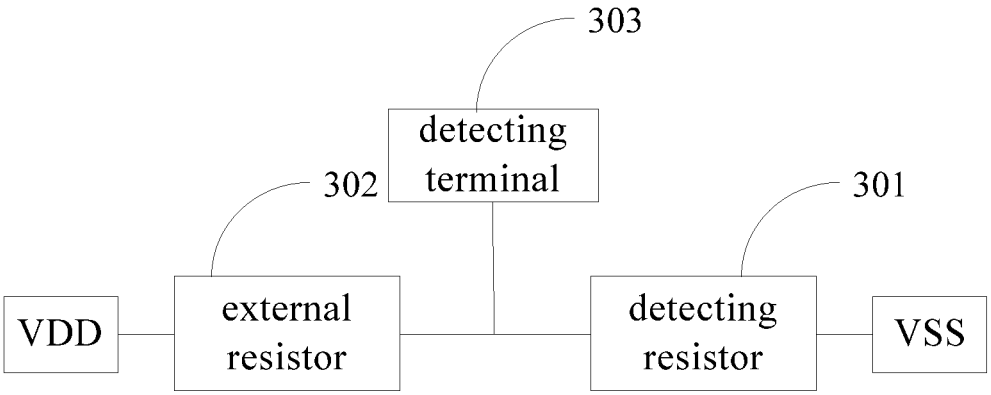
FIG. 3*a* and FIG. 3*b* are schematic diagrams showing the working principle of a temperature sensor and a temperature detecting circuit according to an exemplary embodiment of the present disclosure.
Figure 3B:
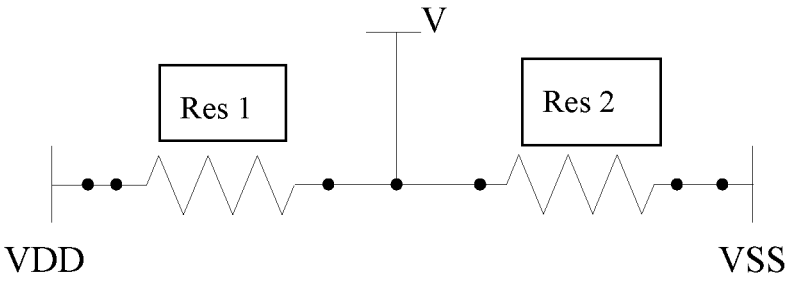

For example, an exemplary schematic diagram of the operation of the temperature sensor 201 and the temperature detecting circuit 202 is shown in FIG. 3*a*. The equivalent circuit diagram corresponding to FIG. 3*a* is shown in FIG. 3*b*. Res 1 represents an external resistor 302, and Res 2 represents a detecting resistor 301. The external resistor 302 is located inside the temperature detecting circuit 202 and is a resistor having a fixed resistance value provided to match the detecting resistor 301. The detecting resistor 301 corresponds to the temperature sensor 201. Both the external resistor 302 and the detecting terminal 303 belong to the temperature detecting circuit 202. When the temperature of the electroluminescent display panel decreases while being within the limit temperature range and less than the second standard temperature, the resistance value of the detecting resistor 301 is lowered, and the voltage value of the detecting terminal 303 is decreased accordingly. When the temperature of the electroluminescent display panel rises while being within the limit temperature range and higher than the first standard temperature, the resistance value of the detecting resistor 301 increases, causing the voltage value of the detecting terminal 303 to increase correspondingly. The temperature detecting circuit 202 then transmits the processed result to the controller 203 through the detecting terminal 303. The controller 203 then causes the driving voltage generator 204 to generate a corresponding driving voltage.

In some embodiments, in the driving device provided by the embodiment of the present disclosure, the temperature detecting circuit 202 may be configured to determine a temperature range in which the detected temperature of the electroluminescent display panel is located; the controller 203 may be configured to, based on a corresponding relationship between the temperature interval and the driving voltage of the electroluminescent display panel, adjust the driving voltage of the electroluminescent display panel to a driving voltage corresponding to the temperature range in which the detected temperature of the electroluminescent display panel is located.

When the size of the electroluminescent display panel is large, and only one temperature sensor 201 is provided, the detected temperature of the electroluminescent display panel may be inaccurate. Therefore, in such embodiments, at least two temperature sensors 201 may be used.

In some exemplary embodiments, as shown in FIG. 2, the driving device 200 may further include a power controller 205. The power controller 205 may be configured to, in response to the detected temperature of the electroluminescent display panel not being within operating temperature range, disconnect a power supply of the electroluminescent display panel under the control of the controller 203.

Figure 4A:
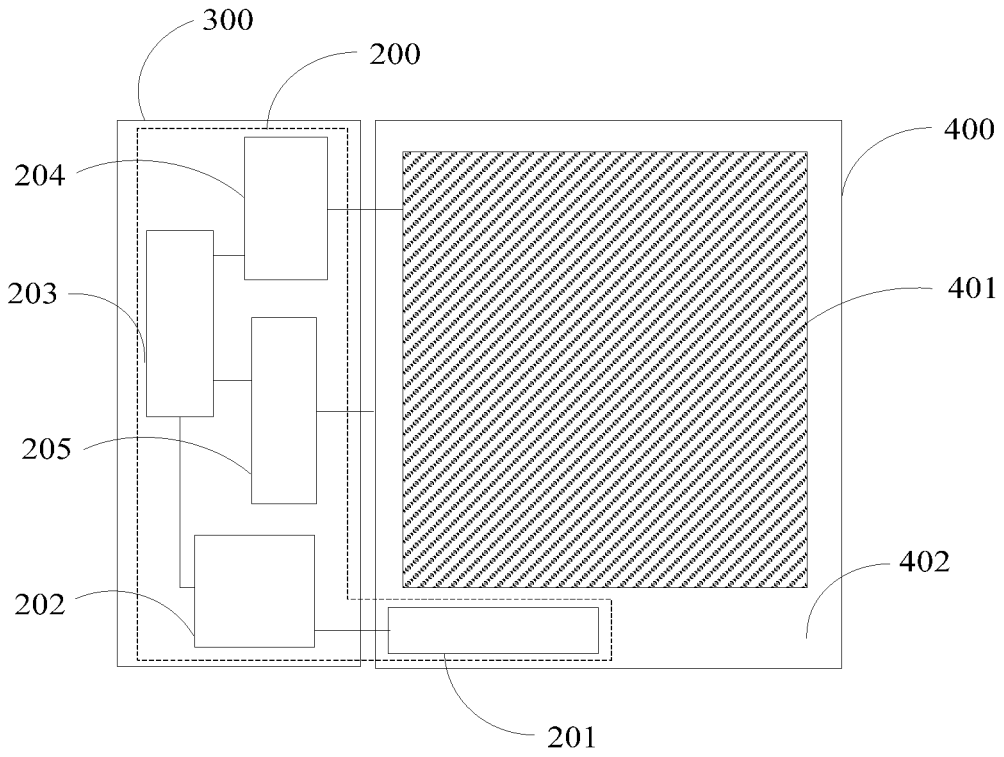
FIG. 4*a* and FIG. 4*b* are structural schematic diagrams of an electroluminescent display panel according to an exemplary embodiment of the present disclosure.
Figure 4B:
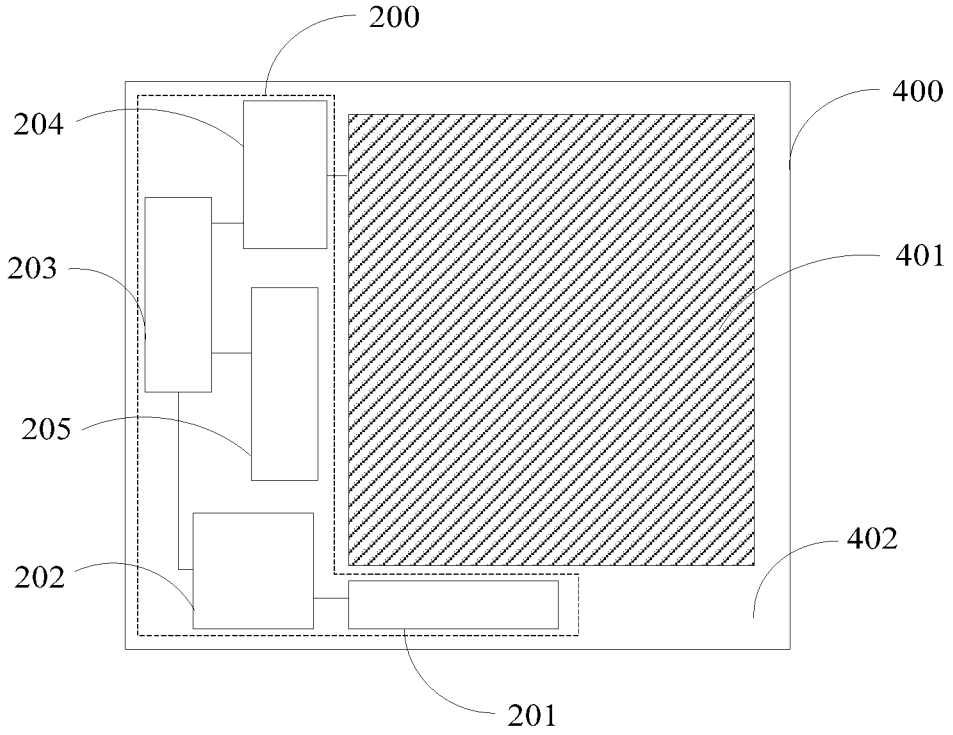

An exemplary embodiment of the present disclosure further provides an electroluminescent display panel. As shown in FIG. 4*a* and FIG. 4*b*, the electroluminescent display panel may include the drive device 200 according to any one of the above mentioned exemplary embodiments (indicated in the dashed box). In the illustrated exemplary embodiment, the temperature sensor 201 is located within the electroluminescent display panel 400.

For example, as shown in FIG. 4*a* and FIG. 4*b*, the electroluminescent display panel 400 may include a display area 401 (area filled by oblique lines) and a non-display area 402 (unfilled area). The temperature sensor 201 may be disposed in the non-display area 402. For example, the temperature sensor 201 may also be disposed in the display area 401.

In some exemplary embodiments, the manufacturing process of the electroluminescent display panel provided with the temperature sensor 201 is consistent with that of the conventional electroluminescent display panel, and no additional process is required, which is advantageous for the reduction of manufacturing cost.

In some exemplary embodiments, the temperature detecting circuit 202, the controller 203, the driving voltage generator 204, and the power controller 205 may be disposed on a print circuit board (PCB) 300. The PCB 300 may be connected to one side of the electroluminescent display panel 400 in an external hanging manner, as shown in FIG. 4*a*.

In some exemplary embodiments, the PCB 300 provided with the temperature detecting circuit 202, the controller 203, the driving voltage generator 204, and the power controller 205 may also be disposed in the non-display area 402 of the electroluminescent display panel 400. Alternatively, but without limitation, the temperature detecting circuit 202, the controller 203, the driving voltage generator 204, and the power controller 205 are disposed directly in the non-display area 402 of the electroluminescent display panel 400, as shown in FIG. 4*b*.

An exemplary embodiment of the present disclosure further provides a display device including the electroluminescent display panel according to the above mentioned embodiment. The display device can be any product or component with a display function, such as mobile phone, tablet computer, TV, display, notebook computer, digital photo frame, and navigation device (such as a global positioning receiver system). The implementation of the display device can refer to the exemplary embodiments of the above mentioned electroluminescent display panel, which will not be repeated herein.

The exemplary embodiments of the present disclosure provide an electroluminescent display panel, a driving method thereof, a driving device and a display device. When a change in the temperature of the electroluminescent display panel is detected, the cathode voltage of the electroluminescent device changes accordingly. By adjusting the driving voltage of the electroluminescent device, the light-emitting state of the electroluminescent display panel is maintained between a light-emitting state corresponding to a first standard temperature and a light-emitting state corresponding to a second standard temperature. Moreover, the disclosed driving method does not need to add new manufacturing processes, and does not affect the display quality of the screen. The driving voltage is required to be adjusted based on the temperature change of the electroluminescent display panel. Thus, the normal operation of the electroluminescent display panel is ensured, and the reliability and quality assurance of the electroluminescent display panel are improved.

It can be understood that the above embodiments are merely exemplary embodiments used for illustrating the principle of the present disclosure, and the present disclosure is not limited thereto. For a person of ordinary skill in the art, variations and improvements may be made without departing from the spirit and essence of the present disclosure. These variations and improvements are also considered to be within the scope of the present disclosure.

What is claimed is:

1. A driving method of an electroluminescent display panel, comprising:

detecting a temperature of the electroluminescent display panel;

in response to the temperature of the electroluminescent display panel being within an operating temperature range and being higher than a first standard temperature, adjusting a driving voltage of the electroluminescent display panel to a first driving voltage lower than a standard driving voltage;

in response to the temperature of the electroluminescent display panel being within the operating temperature range and being lower than a second standard temperature, adjusting the driving voltage of the electroluminescent display panel to a second driving voltage higher than the standard driving voltage; and in response to the temperature of the electroluminescent display panel not being within the operating temperature range, disconnecting a power supply of the electroluminescent display panel;

wherein the first standard temperature is higher than or equal to the second standard temperature.

2. The driving method according to claim 1, wherein adjusting the driving voltage of the electroluminescent display panel to the first driving voltage lower than the standard driving voltage, and adjusting the driving voltage of the electroluminescent display panel to the second driving voltage higher than the standard driving voltage comprises:

determining a temperature range in which the temperature of the electroluminescent display panel is located;

based on a corresponding relationship between the temperature range and the driving voltage of the electroluminescent display panel, adjusting the driving voltage of the electroluminescent display panel to a driving voltage corresponding to the temperature range in which the temperature of the electroluminescent display panel is located.

3. The driving method according to claim 1, further comprising:

in response to the temperature of the electroluminescent display panel being between the first standard temperature and the second standard temperature, setting the driving voltage of the electroluminescent display panel to the standard driving voltage.

4. The driving method according to claim 1, wherein detecting the temperature of the electroluminescent display panel comprises: detecting the temperature of the electroluminescent display panel based on a time interval.

5. The driving method according to claim 2, further comprising:

in response to the temperature of the electroluminescent display panel being between the first standard temperature and the second standard temperature, setting the driving voltage of the electroluminescent display panel to the standard driving voltage.

6. The driving method according to claim 2, wherein detecting the temperature of the electroluminescent display panel comprises: detecting the temperature of the electroluminescent display panel based on a time interval.

7. A driving device for an electroluminescent display panel, comprising: a temperature sensor, a temperature detecting circuit, a controller, a driving voltage generator, and a power controller;

wherein the temperature sensor is configured to detect a temperature of the electroluminescent display panel;

the temperature detecting circuit is configured to determine whether the temperature of the electroluminescent display panel is within an operating temperature range, whether the temperature of the electroluminescent display panel is higher than a first standard temperature or lower than a second standard temperature; the first standard temperature is higher than or equal to the second standard temperature;

the controller is configured to: in response to the temperature of the electroluminescent display panel being within the operating temperature range and being higher than the first standard temperature, causing the driving voltage generator to adjust a driving voltage of the electroluminescent display panel to a first driving voltage lower than a standard driving voltage; and in response to the temperature of the electroluminescent display panel being within the operating temperature range and being lower than the second standard temperature, causing the driving voltage generator to adjust the driving voltage of the electroluminescent display panel to a second driving voltage higher than the standard driving voltage, the power controller is configured to in response to the temperature of the electroluminescent display panel not being within the operating temperature range, disconnect a power supply of the electroluminescent display panel under the control of the controller.

8. The driving device according to claim 7, wherein the temperature detecting circuit is configured to determine a temperature range in which the temperature of the electroluminescent display panel is located;

the controller is configured to, based on a corresponding relationship between the temperature range and the driving voltage of the electroluminescent display panel, adjust the driving voltage of the electroluminescent display panel to a driving voltage corresponding to the temperature range in which the temperature of the electroluminescent display panel is located.

9. The driving device according to claim 7, wherein the number of the temperature sensor is at least two.

10. The electroluminescent display panel comprising the drive device according to claim 7, wherein the temperature sensor is located within the electroluminescent display panel.

11. A display device comprising the electroluminescent display panel according to claim 10.

12. The display device according to claim 11, wherein the temperature detecting circuit is configured to determine a temperature range in which the temperature of the electroluminescent display panel is located;

the controller is configured to based on a corresponding relationship between the temperature range and the driving voltage of the electroluminescent display panel, adjust the driving voltage of the electroluminescent display panel to a driving voltage corresponding to the temperature range in which the temperature of the electroluminescent display panel is located.

13. The electroluminescent display panel according to claim 10, wherein the temperature detecting circuit is configured to determine a temperature range in which the temperature of the electroluminescent display panel is located;

the controller is configured to based on a corresponding relationship between the temperature range and the driving voltage of the electroluminescent display panel, adjust the driving voltage of the electroluminescent display panel to a driving voltage corresponding to the temperature range in which the temperature of the electroluminescent display panel is located.

14. The electroluminescent display panel according to claim 10, wherein the number of the temperature sensor is at least two.

* * * * *